United States Patent [19]

Gengler et al.

[11] 4,361,478

[45] Nov. 30, 1982

[54] METHOD OF PREHEATING HYDROCARBONS FOR THERMAL CRACKING

[75] Inventors: Hans Gengler, Munich; Wolfgang Schwab, Wolfratshausen, both of Fed. Rep. of Germany; Fraser Wall, Warrington; Thomas Bailey, Yeadon, both of Pa.

[73] Assignees: Linde Aktiengesellschaft, Wiesbaden, Fed. Rep. of Germany; Selas Corporation of America, Dresher, Pa.

[21] Appl. No.: 103,294

[22] Filed: Dec. 13, 1979

[30] Foreign Application Priority Data

Dec. 14, 1978 [DE] Fed. Rep. of Germany ..... 2854061

[51] Int. Cl.[3] ..... C10G 9/14; C10G 9/36

[52] U.S. Cl. ..... 208/130; 208/132

[58] Field of Search ..... 208/106, 130, 132; 122/240 R, 356; 126/109

[56] References Cited

U.S. PATENT DOCUMENTS

| | | | |
|---|---|---|---|
| 2,060,338 | 11/1936 | Nelson | 208/132 |
| 2,457,096 | 12/1948 | Swanson | 208/132 |
| 2,852,440 | 9/1958 | Smith et al. | 208/132 |
| 3,580,959 | 5/1971 | Dorner | 208/132 |
| 3,711,568 | 1/1973 | Cooper | 208/132 |

OTHER PUBLICATIONS

Chemical Engineering Progress, vol. 74, Jul. 1978, pp. 45–50.

*Primary Examiner*—T. M. Tufariello
*Attorney, Agent, or Firm*—Karl F. Ross

[57] ABSTRACT

A cracking furnace has a radiant heating zone provided with fuel-fired burners and through which a preheated feedstock is passed, combustion gases from the radiant heating zone passing into a convection zone before being discharged from said furnace. The convection zone is provided with heat-exchanger means for preheating said feedstock. The heat-exchanger means in the convection zone is subdivided into a plurality of functionally separated heat-exchanger bundles and the feedstock is passed selectively through the bundles in accordance with the composition of the feedstock.

3 Claims, 2 Drawing Figures

METHOD OF PREHEATING HYDROCARBONS FOR THERMAL CRACKING

FIELD OF THE INVENTION

Our present invention relates to a method of preheating hydrocarbon feedstock prior to the thermal cracking of the hydrocarbons in the radiant heating zone of a cracking furnace provided with burners and, more particularly, to a method of and an apparatus for the heating of the hydrocarbon feed and other fluids, e.g. a diluent for the hydrocarbon feed in a convection zone of a cracking furnace provided with a heat exchanger for this purpose which abstracts heat from the combustion gases of the furnace.

BACKGROUND OF THE INVENTION

In the production of olefins by the thermal cracking of a hydrocarbon feed it is necessary to bring the hydrocarbons in the cracking zone of the cracking furnace to relatively high temperatures, generally about 550° C. to 900° C. if the desired conversion is to be obtained during the brief residence time of the hydrocarbon in this zone.

To make it possible to attain these temperatures within the cracking zone, it has been found to be necessary, or at least desirable, to preheat the hydrocarbon before the feedstock enters the cracking zone, to relatively high temperatures.

Since the cracking generally is carried out in the presence of water vapor (steam), as an inert diluent, it is generally desirable to preheat the steam to the preferred input temperature at the cracking zone.

The high temperatures required in the cracking zone can be attained by passing the feedstock through cracking tubes which extend through a radiation zone of a burner-fired cracking furnace. The hot combustion gases resulting from the use of fuel-fired burners have a relatively high heat content as they leave the cracking zone and can be used for preheating the feed and even other fluids as may be desirable. To this end, the combustion gases before being vented through a stack, are passed through a convection zone of the furnace which is provided with a heat exchanger traversed by the feedstock and/or other fluids to be heated.

Waste heat recovery in this fashion is known in the art. A typical system utilizing heat exchangers in the convection zone is described in *Chemical Engineering Progr.*, Vol. 74, 1978, pp. 45–50.

In this system, the hot combustion gases are initially passed over a heat exchanger in which the feed for the cracking zone is heated to the inlet temperature of this zone. A further heat exchanger, downstream of the first, serves to generate heated high pressure steam while yet another heat exchanger produces process steam which is fed with the hydrocarbons as the feed to the radiation zone at the inlet temperature thereof.

Still other heat exchange processes can be carried out to further cool the combustion gases and abstract heat therefrom before these gases leave the convection zone, e.g. to heat feed water for the steam generating process and/or to raise the hydrocarbon feedstock to a somewhat higher temperature before it is introduced into the first-mentioned heat exchanger.

For the cracking of certain hydrocarbon feedstocks, e.g. in the cracking of ethane or naphtha, the individual heat exchanger in the convection zone must be so dimensioned to allow optimum utilization of the heat content of the combustion gas.

With charging economic conditions, product demand and availability of different feedstocks, however, there is a change in the effectiveness of heat utilization or the heating effect in heat exchangers of given dimensions and this requires changes in the process conditions.

For example, if it is desired to have a constant output of a given cracking product, e.g. ethylene, with variations in the types of feedstock used, one must adjust the quantity of steam used as a diluent, alter the throughput of the feedstock etc.

Such changes in process conditions frequently require sharp changes in the throughputs both of the steam and of the feedstock so that the quantities per unit time traversing the heat exchangers may vary, depending upon the demands placed upon the system, thereby shifting the actual operating conditions of the heat exchanger from the optimum designed condition.

Optimum utilization of the waste heat cannot be ensured and frequently significant amounts of energy are lost or the process deteriorates.

OBJECTS OF THE INVENTION

It is the principal object of the invention to provide a method of preheating feed materials for a fuel-fired cracking furnace which obviates the disadvantages of earlier systems as enumerated above.

Yet another object of our invention is to provide an improved process for cracking hydrocarbons, involving preheating the feedstock, in the radiation zone of a burner-fired cracking furnace, whereby the recovery of heat from the exhaust gases can be optimized.

It is also an object of the invention to provide an improved apparatus for carrying out the method or process of the present invention.

SUMMARY OF THE INVENTION

These objects are attained, in accordance with the present invention, in a method wherein a hydrocarbon feedstock and the steam diluent are preheated in at least one heat exchanger arranged in a convection zone of a tube-type burner-fired cracking furnace upstream of the venting stack thereof by subdividing the heat exchanger into a multiplicity of tube bundles which are traversed in succession by the fluids to be preheated or heated, and the sequence of passage of the fluids through a plurality of these bundles is changed to suit changing operating parameters or conditions of the cracking furnace. Alternatively, or in addition, the various fluids can be selectively shifted to one or more of the bundles in accordance with these conditions so that the bundles individually traversed by the fluids can be increased or decreased in number. This can be expressed as selectively feeding at least one of the fluids to be heated through a selected number of bundles in accordance with variations in the feedstock or like operating conditions.

With the system of the present invention, therefore, it is possible with changing feedstocks to switch over the sections of the heat exchanger means in bundle-wise manner and thereby vary the effective heat exchange surface to compensate for the through-puts and physical characteristics, for example, the boiling points or specific heats of changing feedstocks.

By switching in and out the fluids to respective heat exchangers it is also possible to vary the locations at which the process steam or other diluent mixes with the hydrocarbon or to allow heat exchanger bundles not in use for the fluids of the cracking process to be employed for other heating modes. This maximizes the heat absorption from the waste gases even where the recovery may not be necessary to preheat the input to the cracking furnace.

In the thermal cracking of heavy hydrocarbons which must be initially hydrogenated and thereafter cracked, one or more heat exchanger bundles can heat the hydrocarbon to hydrogenation temperature. In this case, the heat exchanger bundle used for generating high pressure steam when naphtha is cracked, can be employed.

The convection zone of the cracking furnace is thus provided with a series of heat exchanger bundles which can be combined in series or in parallel using standard switchover devices, to vastly increase the versatility of the unit. The switchover can be effected by ducts advantageously lying outside the convection zone, and valves connecting these ducts. Naturally, these valves should be completely tight to prevent leakage of hot combustible hydrocarbons.

BRIEF DESCRIPTION OF THE DRAWING

The above and other objects, features and advantages will become more readily apparent from the following description, reference being made to the accompanying drawing, in which.

SPECIFIC DESCRIPTION AND EXAMPLES

Figure 1:
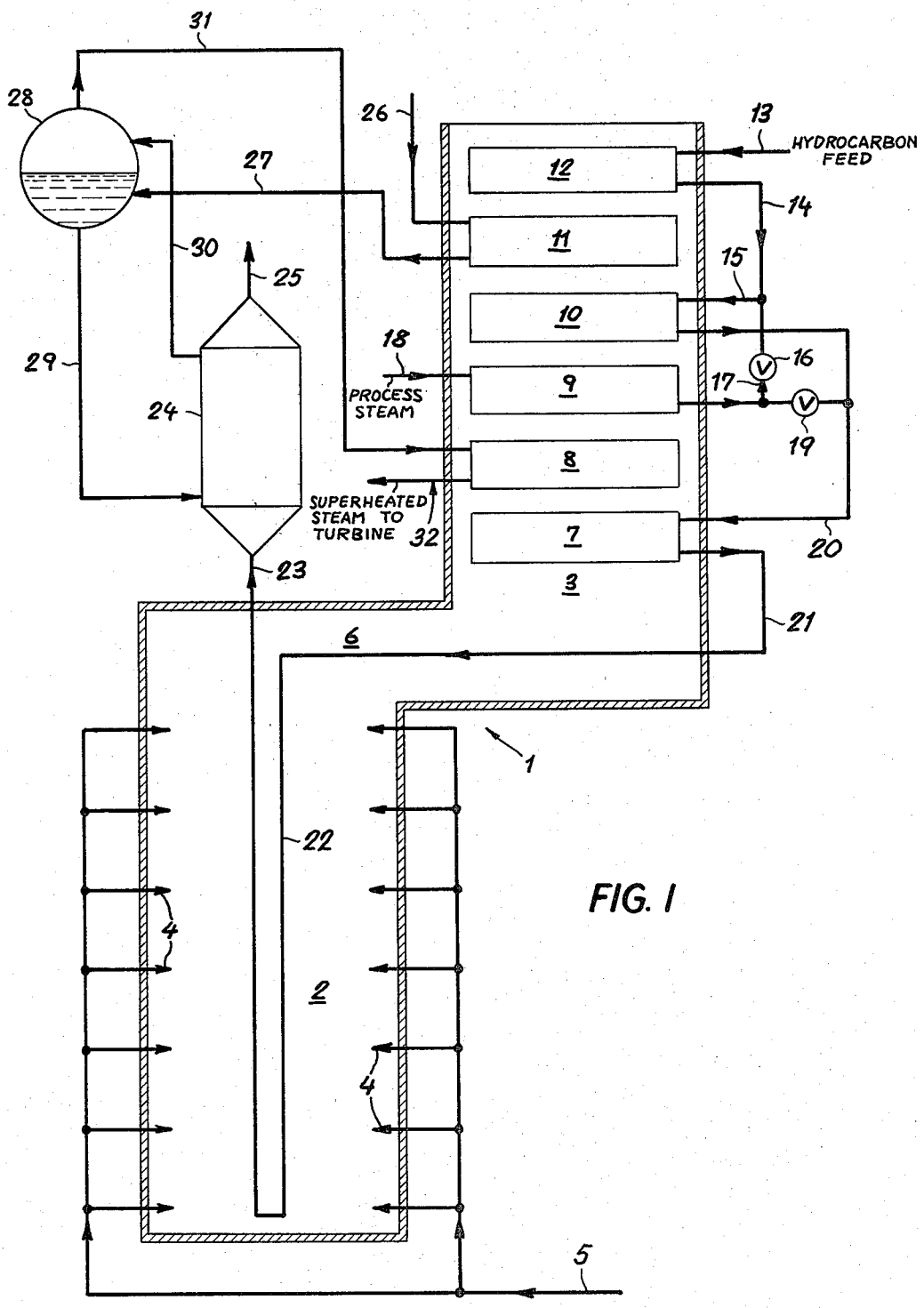
FIG. 1 is a diagrammatic vertical cross-sectional view through a cracking furnace embodying the principles of the present invention.

In FIG. 1 of the drawing we have shown a cracking furnace 1 which can be used for the thermal cracking of naphtha or gas oil. The furnace comprises a radiation zone 2 and a convection zone 3, the latter being connected to the smokestack or other venting unit, e.g. via a gas cleaner.

The radiation zone 2 is formed along its side walls with burners 4 which are supplied with a liquid or gaseous fuel via the line 5 and the usual combustion air by means not shown. The feedstock to be cracked passes through the radiation zone 2 in pipes or tubes as represented by the loop 22 in FIG. 1 and is brought to the high temperature necessary for cracking.

The hot combustion gases resulting from the firing of the burners 4 pass upwardly through the flue duct 6 into the convection zone. The heat which otherwise would be lost with the exhaust gas is recovered by a series of heat exchangers 7 through 12, each of which may be of the tube-bundle type (see FIG. 2) before the gases emerge relatively cool at the upper end of the convection zone.

The fresh-hydrocarbon feed is supplied via line 13, e.g. to the heat exchanger 12 at the upper end of the convection zone and is somewhat prewarmed with the cooled down exhaust gas. Warmed feedstock is then supplied via lines 14 and 15 to the heat exchanger 10 where it is further preheated by hotter combustion gases.

Line 17 opening via a valve 16 into line 15 upstream of the heat exchanger 10 can deliver process steam for mixing with the hydrocarbon at this stage.

The process steam is fed to the heat exchanger 9 via line 18.

A second valve 19 can deliver the superheated process steam selectively also to line 20 and hence to mixture with the heated feedstock from heat exchanger 10. The valves 16 and 19 thus selectively control the feed locations at which process steam is combined with the hydrocarbon feed.

The resulting mixture is then heated to the desired temperature for input to the cracking zone in the heat exchanger 7 and is conducted via line 21 to the loop 22.

The hot cracking gas is delivered at 23 to a quench cooler 24 to terminate the cracking reaction, the product gas being recovered at 25 and being subjected thereafter to fractionation.

A line 26 delivers feed water to the heat exchanger 11, the hot feed water being carried via pipe 27 to a high pressure steam drum 28. The feed water serves as a coolant for the quencher 24 and is delivered thereto via line 29.

The resulting steam is delivered via line 30 to the steam chamber in the upper part of drum 28.

The high pressure steam is withdrawn at 31 and is heated in heat exchanger 8 by the combustion gases, the superheated high pressure steam at 32 being utilized elsewhere, e.g. to drive a turbine producing motive power or electrical energy.

In the configuration shown, the feedstock can be naphtha, whereupon valve 16 is opened and valve 19 is closed. The naphtha is fully vaporized upon the admixture with the steam.

When gas oil is to be cracked, valve 16 is closed and steam is fed via line 19 to spontaneously vaporize the organic feed. The heat exchanger 10 operates upon a steam hydrocarbon mixture in the case of naphtha but upon undiluted gas oil.

SPECIFIC EXAMPLE

With naphtha as a feedstock, the hydrocarbon is fed at a temperature of 100° C. to the heat exchanger 12 and is there heated to 157° C. and partially vaporized. Before the naphtha enters the heat exchanger 10 it is mixed with process steam which has been heated at exchanger 9 from 160° C. to 490° C. so that the mixture entering heat exchanger 10 has a temperature of 214° C.

The mixture, having been heated to 397° C. is fed to the heat exchanger 7, the output temperature being 615° C. In the heat exchanger 11, feed water is heated from 130° C. to 230° C. and heat exchanger 8, high pressure steam is superheated from 329° C. to 520° C.

The hot combustion gas leaves the radiation zone 2 at 1139° C., is cooled by the heat exchanger 7 to 897° C., by the heat exchanger 8 to 660° C., by the heat exchanger 9 to 565° C., by the heat exchanger 10 to 376° C., by the heat exchanger 11 to 212° C. and by the heat exchanger 12 to 150° C.

Further cooling of the combustion gases is not generally desirable since they contain corrosive components which can form upon condensation. The acid dewpoint for the combustion gases, assuming a conventional sulphur content between 0.5 and 2% by weight, is between 100° and 130° C. so that the temperature should not be dropped to this level.

When the operations are carried out with gas oil preheated to 100° C., the temperature upon leaving heat exchanger 12 is 185° C. and upon leaving heat exchanger 10 is 350° C. The process steam is heated in exchanger 9 from 160° C. to 412° C. and upon mixing, the temperature of the feed to heat exchanger 7 is 338° C. The output temperature at line 21 is 537° C. Feed water in exchanger 11 is heated from 130° C. to 265° C. and the high pressure steam in exchanger 8 is superheated from 329° C. to 520° C.

The combustion gases at 1110° C. from the radiation zone are cooled in succession by the heat exchangers 7 through 12 to 864° C., 640°, 527°, 373°, 252° and 150° C.

If the quantities in naphtha operation are given a value of 100, the hydrocarbon feed for gas oil operation is 104, the feed water is 75, the steam from heat exchanger 9 is 166 and the high pressure steam generated is 76.

Utilizing the heat pickup in naphtha operation with a value of 100 as a basis, the gas oil operation yields the following values: 85 in heat exchanger 12, 93 in heat exchanger 11, 81 in heat exchanger 10, 126 in heat exchanger 9, 90 in heat exchanger 8 and 102 in heat exchanger 7.

Figure 2:
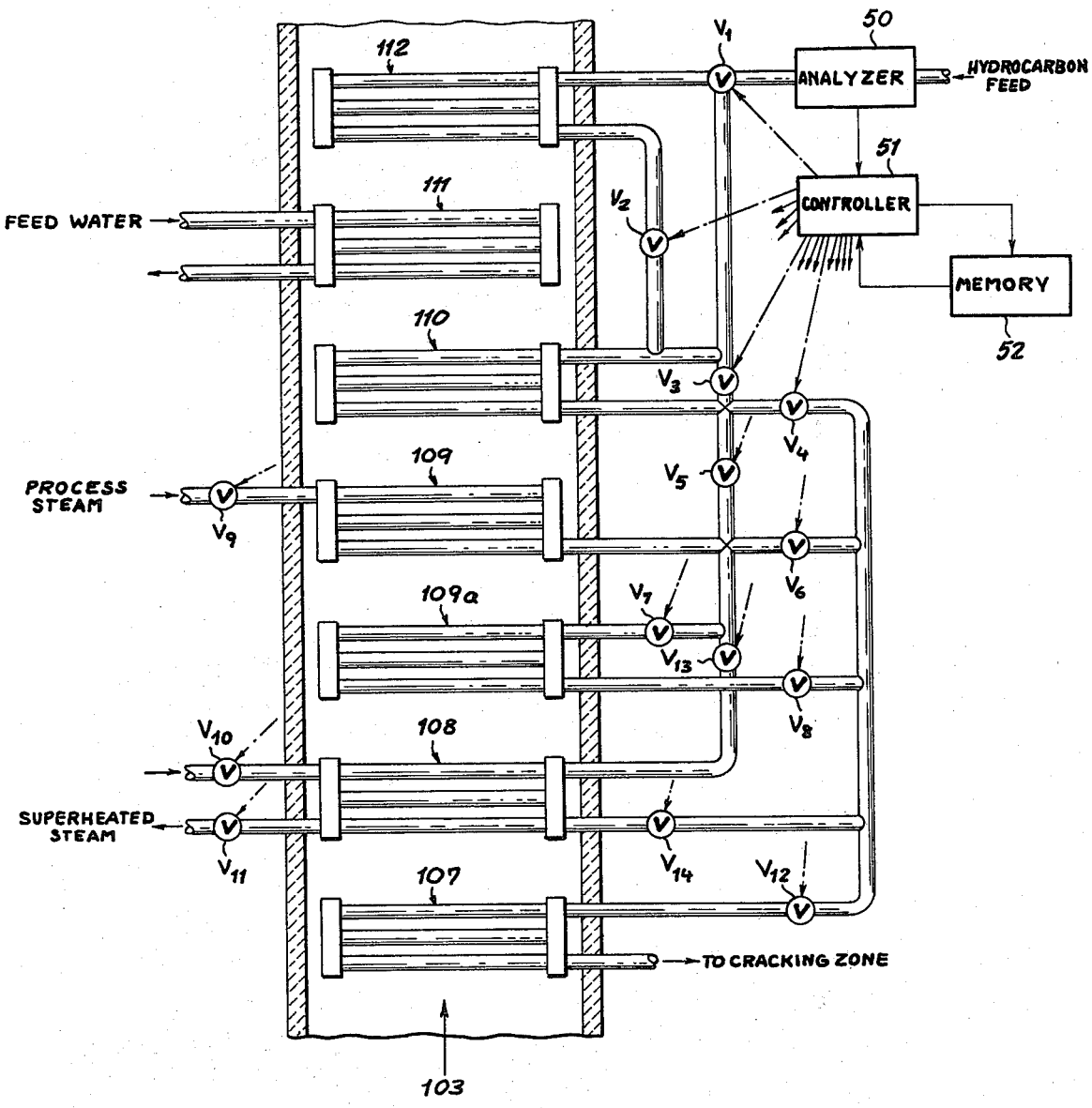
FIG. 2 is a diagram illustrating other aspects of the invention relating to the switchover of the heat exchange bundles.

In FIG. 2 we have shown an embodiment to the invention in which the heat exchangers 107 through 112 are provided in the manner described generally in connection with FIG. 1, although an additional heat exchanger **109*a* is provided. The valves $V_1$ through $V_{14}$ are provided between the respective ducts so that, in addition to the modes of operation described, the hydrocarbon feed can be passed to heat exchangers 112, 110, 109*a*, 108 and 107 in series or can bypass the heat exchangers 108, 109*a* and 112, for example. The process steam can be generated either by the heat exchanger 108 alone or by a series connection of heat exchangers 109 and 109*a*. The high pressure superheated steam heat exchanger 108 has a dual purpose and can be used to heat the hydrocarbon steam mixture or the steam as previously described. The valves $V_1$ through $V_{14}$ may be manually set in response to the feed although preferably an analyzer 50 is provided which detects the boiling point of the feed and operates a controller 51 for the valve which may have a memory 52** programmed to provide the valve settings for any given hydrocarbon feedstock.

We claim:

1. In a method of operating a cracking furnace suitable for the cracking of different hydrocarbon feedstocks in the presence of steam to produce ethylene, said cracking furnace having a radiant heating zone provided with fuel-fired burners and through which a preheated mixture of said hydrocarbon feedstock and said steam is passed, combustion gases from said radiant heating zone passing into a convection zone being provided with heat exchanger means for preheating said feedstock and said steam, the improvement which comprises selecting different operation states for the cracking furnace by the steps of:

subdividing the heat exchanger means in said convection zone into a plurality of functionally separated heat exchanger bundles;

passing said hydrocarbon feedstock selectively through a first bundle or a first series of bundles of the heat exchanger means;

passing said steam separately from said hydrocarbon feedstock selectively through a second bundle or a second series of bundles of the heat exchanger means;

mixing said preheated hydrocarbon feedstock and said preheated steam before conducting the mixture into said radiant zone of said cracking furnace; and selectively choosing the bundles for preheating of said hydrocarbon feedstock and said steam in accordance with the composition of said hydrocarbon feedstock.

2. The method defined in claim 1 wherein said feedstock is passed through a first series of bundles of the heat exchanger means and the sequence in which said bundles of said first series are traversed by said feedstock is varied in accordance with said composition.

3. The method defined in claim 1 wherein the number of tube bundles of said first series of bundles of the heat exchanger means is varied in accordance with said composition.

* * * * *